US007901515B1

(12) United States Patent
Badesha et al.

(10) Patent No.: US 7,901,515 B1
(45) Date of Patent: Mar. 8, 2011

(54) MEDIA PATH UNIVERSAL CLEANING FLUID COMPOSITION

(75) Inventors: Santokh Badesha, Pittsford, NY (US); Barry P. Mandel, Fairport, NY (US); Matthew M. Kelly, Webster, NY (US); David J. Gervasi, Pittsford, NY (US)

(73) Assignee: Xerox Corporation, Norwalk, CT (US)

( * ) Notice: Subject to any disclaimer, the term of this patent is extended or adjusted under 35 U.S.C. 154(b) by 0 days.

(21) Appl. No.: 12/914,021

(22) Filed: Oct. 28, 2010

Related U.S. Application Data

(62) Division of application No. 12/577,861, filed on Oct. 13, 2009, now Pat. No. 7,846,265.

(51) Int. Cl.
*B08B 3/04* (2006.01)

(52) U.S. Cl. ..... 134/26; 134/27; 134/34; 134/36; 134/40; 134/42; 510/417; 510/432; 510/480; 510/505; 399/343

(58) Field of Classification Search ..... 134/26, 134/27, 34, 36, 40, 42; 510/417, 432, 480, 510/505; 399/343
See application file for complete search history.

(56) References Cited

U.S. PATENT DOCUMENTS

| | | | |
|---|---|---|---|
| 7,105,063 | B1 | 9/2006 | Gibson et al. |
| 7,424,262 | B2 | 9/2008 | Van Bortel et al. |
| 2002/0163556 | A1 | 11/2002 | Premnath et al. |
| 2009/0304420 | A1 | 12/2009 | Klymachyov et al. |

*Primary Examiner* — Sharidan Carrillo
(74) *Attorney, Agent, or Firm* — MH2 Technology Law Group LLP

(57) ABSTRACT

Exemplary embodiments provide a cleaning composition that can include alkane components for cleaning printer members made of elastomeric materials.

14 Claims, No Drawings

MEDIA PATH UNIVERSAL CLEANING FLUID COMPOSITION

CROSS-REFERENCE TO RELATED APPLICATION

This application is a divisional application of U.S. patent application Ser. No. 12/577,861 now U.S. Pat. No. 7,846,265 filed on Oct. 13, 2009, the disclosure of which is incorporated herein by reference.

DETAILED DESCRIPTION

1. Field of Use

The present teachings relate generally to cleaning compositions and, more particularly, to cleaning compositions including a component to remove amino-oil contamination from elastomeric materials.

2. Background

Elastomeric materials are used as substrate materials in, for example, drive rollers in electrostatographic devices. Such elastomeric substrate materials include EPDM (ethylene propylene diene monomer) rubber, silicone modified EPDM, silicone and/or variations of urethane.

When elastomeric substrates are used in paper paths of copiers and printers, they are often contaminated with fuser oil, clay from coated media, paper dust, and other materials. This contamination reduces the coefficient of friction of the substrates and results in performance degradation of the transport.

There are many types of cleaning compositions in the art with each including specific cleaning components for cleaning specific substrate materials. It is known that a cleaning composition that includes isopropyl alcohol works well for cleaning urethane or conventional EPDM but not for cleaning silicone modified EPDM or silicone. That is, no single cleaning fluid works well with all substrate materials used in electrostatographic devices.

Thus, there is a need to overcome these and other problems of the prior art and to provide a cleaning composition suitable for cleaning all elastomeric substrates used in electrostatographic devices.

SUMMARY

According to various embodiments, the present teachings include a cleaning composition. The cleaning composition can include a chelating agent in an amount of from about 1% to about 30% by weight; a surfactant in an amount of from about 1% to about 20% by weight; and the balance being a solvent. The solvent of the cleaning composition can further include an alkane component having from about 1 to about 60 carbon atoms, and an alcohol having a ratio with the alkane component, for example, from about 1 to about 67 parts of alkane component per from about 33 to about 99 parts of the alcohol.

According to various embodiments, the present teachings also include a method for cleaning a printer member. In this method, a cleaning composition having a pH value of at least about 7.5 can be used. The cleaning composition can include a chelating agent, a surfactant, an aqueous solvent and an organic solvent including an alkane component and an alcohol in a ratio of, for example, from about 1 to about 67 parts of the alkane component per from about 33 to about 99 parts of the alcohol. The organic solvent can further have a ratio with the aqueous solvent of from about 1 to about 67 parts of the organic solvent per from about 33 to about 99 parts of the aqueous solvent. The cleaning composition can then be applied to a printer member having a contamination on a surface thereof to clean the printer member. At least a portion of the cleaning composition along with at least a portion of the contamination can then be removed from the surface of the printer member.

It is to be understood that both the foregoing general description and the following detailed description are exemplary and explanatory only and are not restrictive of the present teachings, as claimed.

DESCRIPTION OF THE EMBODIMENTS

Reference will now be made in detail to embodiments of the present teachings, examples of which are illustrated in the accompanying drawings. Wherever possible, the same reference numbers will be used throughout the drawings to refer to the same or like parts.

In the following description, reference is made to the accompanying drawings that form a part thereof, and in which is shown by way of illustration specific exemplary embodiments in which the present teachings may be practiced. These embodiments are described in sufficient detail to enable those skilled in the art to practice the present teachings and it is to be understood that other embodiments may be utilized and that changes may be made without departing from the scope of the present teachings. The following description is, therefore, merely exemplary.

Exemplary embodiments provide a cleaning composition that can be used for cleaning printer members of electrostatographic devices.

The printer member can include any member, for example, that is configured in a media path. The printer member can be a member contaminated by, for example, fuser oil, pigment stain, toner resin such as polyester toner resin and zinc fumarate (i.e., a by-product of toner additives), clay from coated media, paper dust and other materials.

The printer member can include, for example, a fuser member, a pressure member, a heat member, a donor member, a backer member, a tension member, a drive member, a turn member and the like. In embodiments, the printer member can be in a form of a roll or a belt. In embodiments, the printer member can include, for example, elastomeric materials including various forms of urethane, ethylene propylene diene monomer (EPDM), silicone, silicone modified EPDM, and/or the like.

Conventional cleaning compositions include isopropyl alcohol for cleaning urethane or plain EPDM, which do not work for silicone modified EPDM or silicone. For example, conventional cleaning compositions can not remove amino-oil based contaminations from the silicone-based elastomeric printer member.

Disclosed herein is a cleaning composition that can be used as a general cleaning composition for cleaning a plurality of printer members contaminated during printing.

In embodiments, the cleaning composition can include, for example, detergents including one or more surfactants, solvents including organic solvents and/or aqueous solvents, and caustic agents including one or more chelating agents. The amount and nature of each component in the cleaning composition can be determined by the requirements of the formulation, the type and concentration of contaminations and the surface material of the printer member to be cleaned.

In embodiments, the one or more solvents can include organic solvents, aqueous solvents and/or combinations thereof. For example, organic solvents can include alkane components, alcohols, glycol ether solvents, and/or ketones. In embodiments, aqueous solvents can include ammonia, base and/or water.

In embodiments, the cleaning composition can further include an organic/aqueous solvent ratio when a combined organic/aqueous solvent is used. For example, from about 1 to about 67 parts of total organic solvent per from about 33 to about 99 parts of total aqueous solvent can be used for the cleaning composition. In an additional example, from about 20 to about 65 parts of total organic solvent per from about 35 to about 80 parts of total aqueous solvent can be used for the cleaning composition. Alternatively, from about 40 to about 60 parts of total organic solvent per from about 60 to about 40 parts of total aqueous solvent can also be used for the cleaning composition.

In embodiments, alkane components used in the cleaning composition can function as an excellent cleaner for cleaning contaminations from, for example, fuser oils such as amino oil on elastomers. This is different from conventional cleaning compositions that do not remove amino-oil contaminations on elastomer-based printer members. Additionally, alkane components such as n-hexane are not classifiable as a human carcinogen (Federal Register/Vol. 66, No. 71/Apr. 12, 2001/Rules and Regulations) by EPA Environmental Protection Agency (EPA).

In embodiments, the alkane component can include, for example, an alkane having a general formula of $C_nH_{2n+2}$ and a cycloalkane having a general formula of $C_nH_{2n}$, where n is the number of carbon atoms ranging from about 1 to about 60, in embodiments, ranging from about 1 to about 45. In other embodiments, the alkane component including an alkane and a cycloalkane can include from about 1 to about 30 carbon atoms.

In embodiments, the alkane having a general formula of $C_nH_{2n+2}$ can include, but is not limited to, methane, ethane, propane, butane, pentane, hexane, heptane, octane, nonane, decane, undecane, dodecane, tridecane, icosane, henicosane, and triacontane. In embodiments, the cycloalkane having a general formula of $C_nH_{2n}$ can include, but is not limited to, cyclopropane, cyclobutane, cyclopentane, cyclohexane, and cycloheptane. In one embodiment, hexane having a chemical formula of $C_6H_{14}$ or $CH_3(CH_2)_4CH_3$ can be used as an exemplary alkane component.

In embodiments, the alkane components can be present in an amount from about 1 percent by weight to about 30 percent by weight of the total cleaning composition. In some embodiments, the cleaning composition can contain from about 1 to about 15 percent alkane components, or in some cases from about 5 to about 15 percent alkane components by weight of the total cleaning composition.

In embodiments, the cleaning composition can include alcohols as a solvent. Exemplary alcohols can include isopropanol, 2-butoxyethanol, ethanol, methanol, butanol, butoxyethanol, and/or the like. Alcohols such as isopropanol can he used to clean, for example, contaminations on the members made of urethane, and plain EPDM rubber.

In embodiments, the alcohols can have a ratio with the alkane components as solvent of the cleaning composition. For example, the ratio therebetween can include from about 1 to about 67 parts of alkane components per from about 33 to about 99 parts of the alcohols. In another example, the ratio therebetween can include from about 20 to about 65 parts of alkane components per from about 35 to about 80 parts of the alcohols, or from about 40 to about 60 parts of alkane components per from about 60 to about 40 parts of the alcohols.

In addition to alkane components and alcohols, exemplary organic solvents that can be used for the disclosed cleaning composition can also include ketones and/or glycol ether solvents including, for example, ethylene glycol n-hexyl ether. Exemplary ketones can include methyl ethyl ketone, methyl isobutyl ketone, methyl amyl ketone, and the like and combinations thereof.

In embodiments, the cleaning composition can have a pH value of more than about 7, for example, from about 7.5 to about 13. In embodiments, the pH value can be in a range from about 8 to about 12.

In embodiments, the cleaning composition can include a base, for example, a strong base selected from potassium hydroxide (KOH), lithium hydroxide (LiOH), sodium hydroxide (NaOH), rubidium hydroxide (RbOH), calcium hydroxide ($Ca(OH)_2$), strontium hydroxide ($Sr(OH)_2$), barium hydroxide ($Ba(OH)_2$), and the like and combinations thereof. The strong base can be present in an amount to provide a desired pH value of the cleaning composition.

In embodiments, the cleaning composition can include one or more chelating agents. The chelating agents can be used to stabilize the formulation of the cleaning composition. For example, the chelating agents can be used to stabilize complex water hardness ions both in the formulation itself, and/or on the treated surface of the printer member.

Examples of such chelating agents can include, but are not limited to, ethylenediamine tetra-acetic acid (EDTA), and/or other polyamino carboxylic acids, nitrilotriacetic acid (NTA), diethylene triamine pentaacetic acid (DTPA), ethylene glycol tetraacetic acid (EGTA), 1,2-bis(o-aminophenoxy)ethane-N, N,N',N'-tetraacetic acid (BAPTA), ethylenediamine tri-acetic acid, gluconic acid, erythorbic acid, ascorbic acid, citric acid, boric acid, pyroboric acid, polyboric acid, anhydrous boric acid, ammonium pentaborate, pyrophosphoric acid, sodium acid pyrophosphate, tripoly phosphoric acid and/or combinations of thereof.

In embodiments, the chelating agents can be present in an amount from about 1 percent by weight to about 30 percent by weight of the total cleaning composition. In some embodiments, the chelating agents can be present in an amount from about 1 percent to about 15 percent, including from about 5 to about 15 percent, by weight of the total cleaning composition.

In embodiments, the cleaning composition can include at least one surface active agent, i.e., surfactant. In embodiments, the surfactant(s) can facilitate the breaking of bonds between the contamination and the printer member to be cleaned, and further emulsify or suspend the resultant freed contamination. The surfactant(s) can also prevent the freed contamination from re-attaching itself to the printer member elsewhere.

In embodiments, the surfactants used for the disclosed cleaning composition can include, for example, ionic or non-ionic surfactants including such as perfluorooctanesulfonate (PFOS), sodium dodecyl sulfate (SDS), sodium laureth sulfate (SLES), alkyl benzene sulfonate (SDS), cetyl trimethylammonium bromide (CTAB), benzalkonium chloride (BAC), alkylphenol poly(ethylene oxide), cetyl alcohol, and the like.

In embodiments, the surfactants can be present in an amount of from about 1 to about 20 percent by weight of the total cleaning composition. In some embodiments, the cleaning composition can contain from about 1 to about 10 percent surfactants, or in some cases from about 1 to about 5 percent surfactants by weight of the total cleaning composition. The type(s) utilized can depend on the specific cleaning requirements.

In embodiments, other ingredients may find utility for special purposes in the cleaning composition. Examples of such optional additives can be thickeners, abrasives, zeolite softeners, and scale control polymers such as polyacrylates, polymaleates, phosphinocarboxylates, as well as co-polymers, ter-polymers and other specialty polymers.

In an exemplary embodiment, the disclosed cleaning composition can include, for example, a chelating agent of ethylenediaminetetraacetic acid (EDTA) in an amount of from about 1% to about 20% by weight; a surfactant of perfluorooctane sulfonate in an amount of from about 1% to about 5% by weight; an alkane component of hexane in an amount of from about 1% to about 20% by weight; an alcohol of isopropanol in an amount of from about 1% to about 40% by weight; a base of NaOH and water.

Various embodiments can also include a method of cleaning a printer member contaminated during an electrostatographic printing process using the disclosed cleaning composition. For example, the method can include applying an efficacious amount of the disclosed cleaning composition to the contaminated printer member surface by spraying, pouring, or otherwise contacting the cleaning composition with the printer member. The contaminated printer member can include for example, fuser oils, pigment stains, toner resins such as polyester toner resin and zinc fumarate (i.e., a by-product of toner additives), clays from coated media, paper dusts and other materials contaminated on elastomeric printer members.

After waiting an efficacious amount of time, the cleaning composition with the contamination to be removed can be rinsed off, for example, by pressurized water, by vacuuming up the residuals, or alternatively, by scrubbing, mechanically or manually, the printer member with a brush, broom, cloth, mop or any absorbent cleaning pad. The application of cleaning composition and the following rinsing and/or vacuuming as above can be optionally repeated for example, for about 1-3 times as desired.

In embodiments, the disclosed cleaning composition can be supplied in a container that is labeled to indicate its use for cleaning, for example, elastomeric printer members. In an exemplary embodiment, a container can be labeled by "Xerox All Roll Cleaning Solution" in accordance with various embodiments of the present teachings. In embodiments, the container can be made of a material including, for example, high density polyetheylene (HDPE) and/or polypropylene such that no chemical interactions can be made between the ingredients of the cleaning composition and the container.

In embodiments, the disclosed cleaning composition can be supplied along with a set of absorbent cleaning pads for removing. In embodiments, the set of absorbent cleaning pads can include a material including, for example, polyester fiber polymer composite pads and polyester and/or polyamide microfiber cloth pads.

While the present teachings have been illustrated with respect to one or more implementations, alterations and/or modifications can be made to the illustrated examples without departing from the spirit and scope of the appended claims. In addition, while a particular feature of the present teachings may have been disclosed with respect to only one of several implementations, such feature may be combined with one or more other features of the other implementations as may be desired and advantageous for any given or particular function. Furthermore, to the extent that the terms "including", "includes", "having", "has", "with", or variants thereof are used in either the detailed description and the claims, such terms are intended to be inclusive in a manner similar to the term "comprising." As used herein, the term "one or more of" with respect to a listing of items such as, for example, A and B, means A alone, B alone, or A and B. The term "at least one of" is used to mean one or more of the listed items can be selected.

Notwithstanding that the numerical ranges and parameters setting forth the broad scope of the present teachings are approximations, the numerical values set forth in the specific examples are reported as precisely as possible. Any numerical value, however, inherently contains certain errors necessarily resulting from the standard deviation found in their respective testing measurements. Moreover, all ranges disclosed herein are to be understood to encompass any and all sub-ranges subsumed therein. For example, a range of "less than 10" can include any and all sub-ranges between (and including) the minimum value of zero and the maximum value of 10, that is, any and all sub-ranges having a minimum value of equal to or greater than zero and a maximum value of equal to or less than 10, e.g., 1 to 5. In certain cases, the numerical values as stated for the parameter can take on negative values. In this case, the example value of range stated as "less than 10" can assume values as defined earlier plus negative values, e.g. −1, −1.2, −1.89, −2, −2.5, −3, −10, −20, −30, etc.

Other embodiments of the present teachings will be apparent to those skilled in the art from consideration of the specification and practice of the present teachings disclosed herein. It is intended that the specification and examples be considered as exemplary only, with a true scope and spirit of the present teachings being indicated by the following claims.

What is claimed is:

1. A cleaning composition comprising:

a chelating agent in an amount ranging from about 1% to about 30% by weight;

a surfactant in an amount ranging from about 1% to about 20% by weight;

an aqueous solvent; and an organic solvent, the organic solvent having a ratio with the aqueous solvent of from about 1 to about 67 parts of the organic solvent per from about 33 to about 99 parts of the aqueous solvent, and the organic solvent further comprising an alkane component and an alcohol, wherein the alkane component comprises from about 1 to about 60 carbon atoms, and the alcohol has a ratio with the alkane component of from about 1 to about 67 parts of the alkane component per from about 33 to about 99 parts of the alcohol.

2. The cleaning composition of claim 1, wherein the alkane component comprises a general formula selected from the group consisting of $C_nH_{2n+2}$ and $C_nH_{2n}$, wherein n is a number of carbon atoms and ranges from about 1 to about 60.

3. The cleaning composition of claim 1, wherein the alkane component is selected from the group consisting of methane, ethane, propane, butane, pentane, hexane, heptane, octane, nonane, decane, undecane, dodecane, tridecane, icosane, henicosane, triacontane, cyclopropane, cyclobutane, cyclopentane, cyclohexane, cycloheptane and a combination thereof.

4. The cleaning composition of claim 1 wherein the ratio further comprises from about 20 to about 65 parts of the alkane component per from about 35 to about 80 parts of the alcohol.

5. The cleaning composition of claim 1, wherein the alkane component is present in an amount ranging from about 1% to about 30% by weight of the total cleaning composition.

6. The cleaning composition of claim 1, wherein the alkane component is present in an amount ranging from about 5% to about 15% by weight of the total cleaning composition.

7. The cleaning composition of claim 1, wherein the alcohol is selected from the group consisting of isopropanol, ethanol, methanol, butanol, butoxyethanol and a combination thereof.

8. The cleaning composition of claim 1, wherein the organic solvent further comprises a glycol ether solvent comprising ethylene glycol n-hexyl ether and a ketone selected from the group consisting of methyl ethyl ketone, methyl isobutyl ketone, methyl amyl ketone, and a combination thereof;

and wherein the aqueous solvent further comprises ammonia and a base selected from the group consisting of potassium hydroxide (KOH), lithium hydroxide (LiOH), sodium hydroxide (NaOH), rubidium hydroxide (RbOH), calcium hydroxide ($Ca(OH)_2$), strontium hydroxide ($Sr(OH)_2$), barium hydroxide ($Ba(OH)_2$) and a combination thereof.

9. The cleaning composition of claim 1, wherein the ratio further comprises from about 20 to about 65 parts of the organic solvent per from about 35 to about 80 parts of the aqueous solvent.

10. The cleaning composition of claim 1 further comprising a pH value ranging from about 7.5 to about 13.

11. The cleaning composition of claim 1 further comprising a pH value ranging from about 8 to about 12.

12. The cleaning composition of claim 1, wherein the chelating agent is selected from the group consisting of polyamino carboxylic acid, ethylenediaminetetra-acetic acid, nitrilotriacetic acid, diethylene triamine pentaacetic acid, ethylene glycol tetraacetic acid, 1,2-bis(o-aminophenoxy) ethane-N,N,N',N'-tetraacetic acid and a combination thereof.

13. The cleaning composition of claim 1, wherein the surfactant is selected from the group consisting of perfluorooctanesulfonate, sodium dodecyl sulfate, sodium laureth sulfate, alkyl benzene sulfonate, cetyl trimethylammonium bromide, benzalkonium chloride, alkylphenol poly(ethylene oxide), cetyl alcohol and a combination thereof.

14. The cleaning composition of claim 1, wherein the chelating agent comprises ethylenediaminetetraacetic acid (EDTA) in an amount of from about 1% to about 20% by weight;

the surfactant comprises perfluorooctane sulfonate in an amount of from about 1% to about 5% by weight;

the alkane component comprises hexane in an amount of from about 1% to about 20% by weight;

the alcohol comprises isopropanol;

and the composition further comprises NaOH.

* * * * *